US005090191A

United States Patent [19]

Mueller

[11] Patent Number: 5,090,191

[45] Date of Patent: Feb. 25, 1992

[54] TUBE GRIPPING APPARATUS FOR A TEXTILE MACHINE

[75] Inventor: Heinz Mueller, Sparwiesen, Fed. Rep. of Germany

[73] Assignee: Zinser Textilmaschinen GmbH, Ebersbach, Fed. Rep. of Germany

[21] Appl. No.: 507,639

[22] Filed: Apr. 11, 1990

[30] Foreign Application Priority Data

Apr. 11, 1989 [DE] Fed. Rep. of Germany ..... 3911857

[51] Int. Cl.[5] ..... D01H 9/00

[52] U.S. Cl. ..... 57/275; 57/266; 57/274; 57/281

[58] Field of Search ..... 57/266, 274-275, 57/281; 74/56

[56] References Cited

U.S. PATENT DOCUMENTS

| | | | |
|---|---|---|---|
| 2,804,778 | 9/1957 | Booth | 74/56 X |
| 3,633,959 | 1/1972 | McCollough et al. | 57/275 X |
| 3,813,866 | 6/1974 | Goldammer et al. | 57/275 |
| 3,854,275 | 12/1974 | Bethea et al. | 57/281 |
| 4,120,526 | 10/1978 | Rohner | 57/275 X |
| 4,208,768 | 6/1980 | Bonner | 57/281 X |
| 4,341,067 | 7/1982 | Kondo et al. | 57/275 |
| 4,598,869 | 7/1986 | Uchida | 57/281 |
| 4,757,679 | 7/1988 | Marzoli | 57/274 X |
| 4,805,352 | 10/1989 | Grassle et al. | 57/267 |
| 4,841,719 | 6/1989 | Sasaki et al. | 57/281 |

FOREIGN PATENT DOCUMENTS

| | | |
|---|---|---|
| 2352729A1 | 4/1975 | Fed. Rep. of Germany . |
| 2249840 | 4/1976 | Fed. Rep. of Germany . |
| 3214128A1 | 10/1983 | Fed. Rep. of Germany . |
| 3702276A1 | 7/1987 | Fed. Rep. of Germany . |
| 3634879A1 | 4/1988 | Fed. Rep. of Germany . |

*Primary Examiner*—Daniel P. Stodola
*Assistant Examiner*—William T. Stryjewski
*Attorney, Agent, or Firm*—Shefte, Pinckney & Sawyer

[57] ABSTRACT

A gripper assembly having a plurality of tube gripping apparatus is provided for transferring full and empty bobbins between the bobbin bank of a textile fly frame and a supply creel. The gripper assembly is mounted on a traveling service unit and includes a drive device for commonly driving the tube gripping apparatus to synchronously grip and release tubes to be transferred. Each tube gripping apparatus includes an axially movable tube engaging member having gripping portions for compressively gripping a tube, a gripping portion drive member pivotally supported in a housing, and a pivot movement converting device for converting pivoting of the gripping portion drive member into axial movement of the tube engaging member. The gripping portion drive member is operatively connected to a common drive shaft of the gripper assembly for driving pivoting thereof. The pivot movement converting device includes a pair of diametrically opposed rollers rotatably supported on the gripping portion drive member and a cooperating cam surface formed on one end of the tube engaging member. A plurality of springs bias the rollers and the cam surface into continuous engagement with one another. Each tube gripping apparatus additionally includes a tube top engaging component and a tube insertion component for insertion into the tube to stabilize the tube during a tube transfer operation.

9 Claims, 5 Drawing Sheets

TUBE GRIPPING APPARATUS FOR A TEXTILE MACHINE

BACKGROUND OF THE INVENTION

The present invention relates to a tube gripping apparatus for a textile machine and, more particularly, to a tube gripping apparatus for gripping a tube of the type onto which yarn is built to form a yarn package.

In U.S. Pat. No. 4,805,352 to Grassle et al., an apparatus is disclosed for exchanging full bobbins on a bobbin bank of a textile fly frame for empty bobbins. The apparatus includes a pivotable gripper assembly mounted to a traveling surface unit, a revolving peg support means having a plurality of pegs for receiving bobbins thereon and means for raising and lowering the pegs to transfer bobbins between the pegs and a creel extending overhead the traveling service unit along its direction of travel. The full bobbins on the bobbin bank of the textile fly frame are arranged in two parallel rows and are uniformly spaced from one another along each row. The creel includes two parallel banks for supporting two parallel rows of empty bobbins in reserve and the empty bobbins are uniformly spaced from one another within each creel row. The gripper assembly is operable to simultaneously transfer a plurality of full bobbins from each of the parallel rows of the bobbin bank to two parallel rows of pegs on the peg support means in the traveling service unit.

The raising and lowering means of the traveling service unit is operable to raise another pair of parallel rows of pegs toward the creel to receive a plurality of empty bobbins from each creel row and to return the thus-loaded pegs to the peg support means. Thereafter, the peg support means is revolved generally 180°. The gripper assembly then grips the parallel rows of empty bobbins supported on the pegs to transfer these empty bobbins to the bobbin bank while the raising and lowering means raises the pegs with full bobbins thereon toward the creel to transfer these bobbins to the creel rows.

The gripper assembly includes a plurality of tube gripping devices each for individually gripping a tube to support the tube during the various transfer operations. In German Offenlegungschrift 37 02 279, a tube gripping device is disclosed having friction components for engaging tubes. Additionally, in German Offenlegungschrift 23 52 729, another tube gripping device is disclosed having movable clamping elements.

SUMMARY OF THE INVENTION

The present invention is an improvement of the prior tube gripper assemblies that provides enhanced operation and effectiveness.

Briefly described, the present invention is directed to a gripper assembly having at least one improved tube gripping apparatus of the type for individually gripping a tube for transfer of the tube during an exchange of full bobbins for empty bobbins on a bobbin bank of a textile fly frame. In this regard, the invention provides an apparatus for selectively gripping a tube of the type onto which yarn is built by a textile machine to form a yarn package. The apparatus includes a housing and a tube engaging member movably supported on the housing for relative axial movement with respect to the housing along a pivot axis, the tube engaging member including a pair of gripping portions, at least one of which is selectively movable radially inwardly with respect to the pivot axis to effect compressive gripping of a tube disposed between the gripping portions by the gripping portions. A gripping portion drive member is movably supported on the housing for pivotal movement about the pivot axis and means are provided for pivoting the gripping portion drive member about the pivot axis.

Means are provided for moving at least one gripping portion radially inwardly in response to relative axial movement of the tube engaging member with respect to the housing. Pivot movement converting means axially moves the tube engaging member with respect to the housing in response to pivoting of the gripping portion drive member about the pivot axis, whereby at least one gripping portion moves radially inwardly to effect compressive gripping of a tube by the gripping portions.

Preferably, the pivot movement converting means includes a pair of rollers, the rollers being mounted on a selected one of the gripping portion drive member and the tube engaging member. Cam means are mounted to the other of the gripping portion drive member and the tube engaging member. The cam means includes a cam surface having an axially varying contour with respect to the pivot axis. Additionally, the pivot movement converting means includes means for continuously biasing the rollers into engagement with the cam surface whereby the tube engaging member moves axially relative to the housing as the rollers move along the cam surface in cam following fashion during pivoting of the griping portion drive member.

According to another aspect of the apparatus of the present invention, the tube engaging member includes an annular tube top engaging component disposed between the gripper portions. Means are provided for movably supporting the tube top engaging component on the gripping portion member for selected relative pivoting movement between the tube top engaging component and the gripping portion drive member. The tube top engaging component frictionally engages the top of a tube which is compressively engaged by the gripping portions for pivoting the tube to securely seat the tube on the spindle of a bobbin bank.

In the preferred embodiment, the tube engaging member includes a tube insertion component disposed in the tube top engaging component. This tube insertion component is compatibly configured with the inner diameter of a tube to be gripped for insertion in the tube to stabilize the tube during gripping by the gripper portions and is movably connected to a shifter rod for axial shifting of the tube insertion component by the shifter rod to selectively insert and retract the tube insertion component into and from a tube to be gripped.

According to another aspect of the present invention, an assembly for groupwise exchange of full bobbin tubes between the bobbin bank of a textile fly frame and a creel is provided by incorporating a plurality of the aforementioned gripping apparatus on the support frame for operation by commonly driving means that includes a common drive shaft extending transversely with respect to the pivot axes and rotatably supported on the support frame. The common drive shaft is rotated by drive means about its axis, and a plurality of linkage means individually interconnect the common drive shaft and the gripping portion drive members for driving movement of the pivot members in response to rotation of the common drive shaft. Each linkage means includes a driven arm connected to a respective one of the gripping portion drive members and extending radially therefrom, a drive arm connected to the shaft and extending radially therefrom and a linking arm interconnecting the driven arm and the drive arm for transmitting rotation of the common drive shaft to each tube gripping apparatus.

According to a further aspect of the preferred embodiment of the apparatus of the present invention, the means for movably supporting the tube top engaging component on the housing includes a shifter rod movably supported on the housing and connected to the tube top engaging component by a ball bearing assembly. The ball bearing assembly permits pivoting movement of the tube top engaging component relative to the shifter rod. The shifter rod extends axially beyond the housing. The means for movably supporting the tube top engaging component also includes means for axially reciprocating the axial shifter rod and control means having a proximity switch for responding to the axial position of the shifter rod.

In another aspect of the preferred embodiment of the apparatus of the present invention, the gripping portion drive member includes a radially extending pin and the shifter rod includes an axially extending slot for receiving the pin therein. The slot permits axial movement of the shifter rod and the tube top engaging component relative to the gripping portion drive member. The shifter rod slot and the gripping portion drive member pin also cooperate to stabilize the shifter rod bal bearing assembly with respect to the gripping portion drive member during relative pivotal movement between the tube top engaging component and the gripping portion drive member.

In the preferred embodiment, the tube engaging member includes a tube insertion component disposed in the tube top engaging component, the tube insertion component being compatibly configured with the inner diameter of a tube to be gripped for insertion in the tube to stabilize the tube during gripping by the gripper portions. The tube insertion component is movably connected to the shifter rod for axial shifting of the tube insertion component by the shifter rod to selectively insert and retract the tube insertion component into and from a tube to be gripped.

DETAILED DESCRIPTION OF THE PREFERRED EMBODIMENTS

In FIGS. 1–5, the preferred embodiment of the tube gripping apparatus of the present invention is illustrated and, in FIGS. 1–4 the preferred embodiment of the gripper assembly of the present invention is illustrated.

Figure 1:
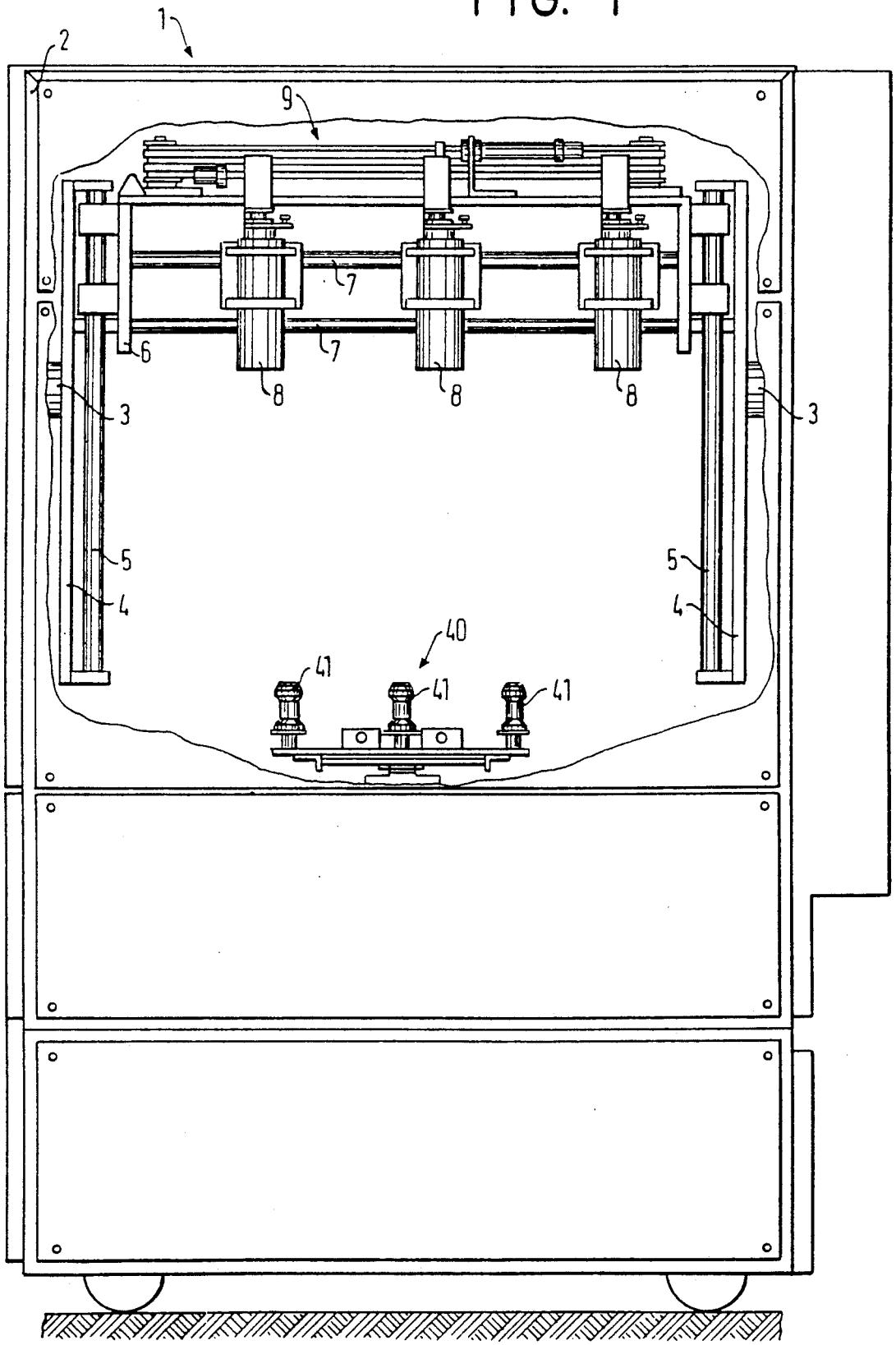
FIG. 1 is a side elevational view of a traveling service unit for exchanging bobbins between a creel and a bobbin bank of a textile fly frame, the raveling service unit incorporating the preferred embodiment of the gripper assembly of the present invention.

In FIGS. 1–4, the preferred embodiment of the gripper assembly of the present invention is illustrated. In FIGS. 5–8, the tube gripping apparatus of the gripper assembly is illustrated in greater detail. As seen in FIG. 1, a traveling service unit 1 is specially configured to exchange full bobbins from the bobbin bank of a textile fly frame (not shown) for empty tubes temporarily stored on a creel (not shown). The traveling service unit 1 includes a gripper assembly 9 pivotally mounted by a pair of pivot shafts 3 to a frame 2 of the traveling service unit. The gripper assembly 9 includes a plurality of tube gripping apparatus 8 for individually gripping the tubes of full bobbins on the bobbin bank for transfer of the full bobbins onto the pegs 41 of a peg support means 40 for support thereby. The peg support means 40 operates in conventional manner to transfer full bobbins supported on its pegs 41 to the creel and to receive empty tubes onto its pegs 41 to position the empty tubes for receipt by the gripper assembly 9. The gripper assembly 9 is operable to subsequently transfer the empty tubes supported on the pegs 41 of the peg support means 40 to the bobbin bank of the textile fly frame.

Figure 2:
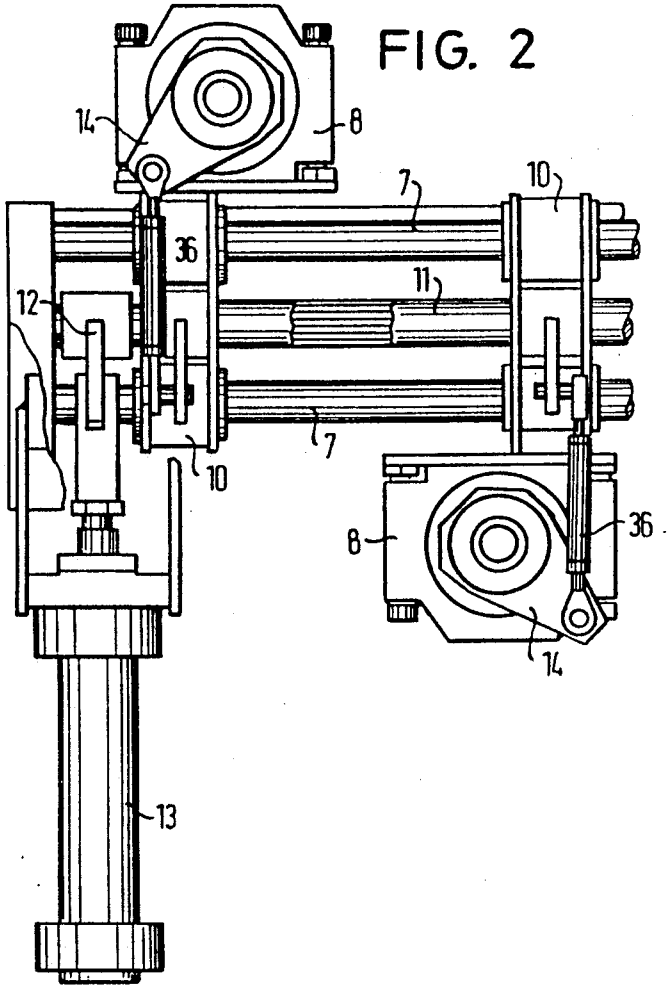
FIG. 2 is a top elevational view of a portion of the gripper assembly shown in Figure showing a pair of the individual tube gripping apparatus of the present invention.

The gripper assembly 9 includes a pair of arm members 4, each mounted to a respective pivot shaft 3. Each arm member 4 supports a cylindrical shaft 5. As best seen in FIGS. 1 and 2, the tube gripping apparatus 8 are each individually mounted to a carriage 10 which is slidably supported on a pair of parallel, spaced longitudinal slide bar members 7. The slide bar members 7 are supported at each end by a frame 6. The frame 6 is movably mounted in conventional manner to the pair of cylindrical shafts 5 for sliding movement therealong to effect raising and lowering of the tube gripping apparatus 8. The gripper assembly 9 additionally includes means for selectively adjusting the spacing of the tube gripping apparatus 8 from one another relative to the axes of the slide bar member 7 to effect appropriate positioning of the tube gripping apparatus 8 relative to the lateral spacing of the full bobbins on the bobbin bank and the different lateral spacing of the pegs 41 of the peg support means 40.

Figure 5:
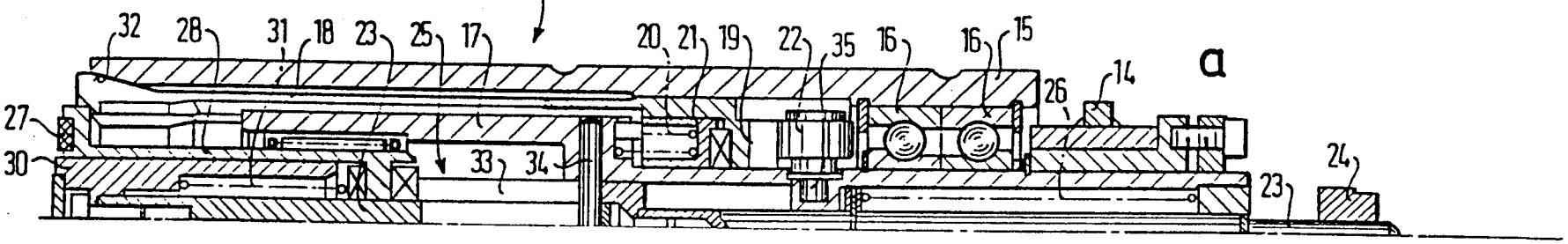
FIG. 5 is a partial elevational view, in vertical section, of the individual tube gripping apparatus shown in FIGS. 2 and 4, taken along lines V—V of FIG. 2, and showing the tube gripping apparatus in its tube release disposition.
Figure 8:
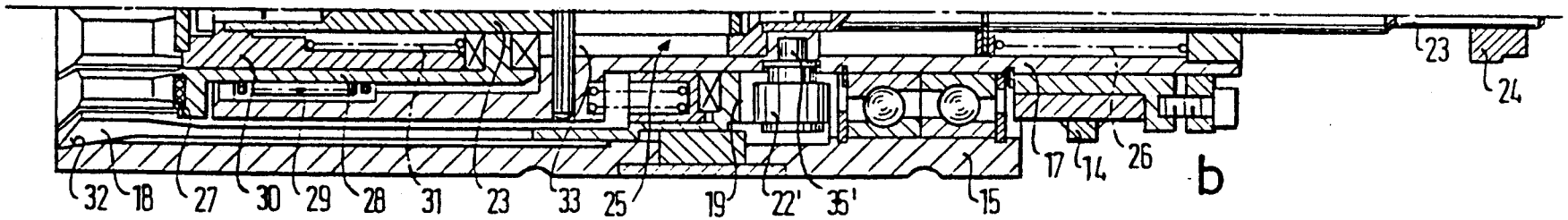
FIG. 8 is a partial elevational view, in vertical section, of the individual tube gripping apparatus shown in FIGS. 2 and 4, taken along lines V—V of FIG. 2, and showing the tube gripping apparatus in its tube gripping disposition.

As best seen in FIG. 5, which shows the one longitudinal half of the tube gripping apparatus, and in FIG. 8, which shows the other longitudinal half of the tube gripping apparatus each tube gripping apparatus 8 includes a housing 15 which is fixedly mounted to the carriage 10 (as seen in FIG. 2) and which includes a hollow interior in which a gripper drive member 17 is disposed. The gripper drive member 17 is rotatably mounted to the interior of the housing 15 by a conventional ball bearing assembly 16 for pivoting of the gripper drive member 17 about a pivot axis PA. A neck portion of the gripper drive member 17 extends axially beyond the top open end of the housing 15 and is fixedly mounted to a driven arm 14.

The housing 15 includes a tube engaging member having a plurality of axially movable gripper portions 18 each having a tapered outer surface 32 tapering radially outwardly relative to the axis PA in the direction toward the bottom open end of the housing 15. The gripping portions 18 are commonly mounted to a ring 19. The interior wall of the housing 15 adjacent its bottom open end is provided with a tapered surface inclined radially outwardly in the direction toward the bottom open end and compatibly configured with the tapered surfaces 32 of the gripping portions 18 for a purpose discussed in more detail below. The ring 19 is axially spaced from the bottom open end of the housing 15 and the ring is disposed in superposed axial relation with a radially outwardly projecting portion of the gripper drive member 17. A ring bearing assembly 21 for rotatably supporting the ring 19 for rotation about the axis PA receives a plurality of springs 20 which extend into engagement with the radially enlarged portion of the gripper drive member 17. The springs 20 bias the ring 19, through the ring bearing assembly 21, in an axial direction toward the top open end portion of the housing 15.

The tube engaging member additionally includes a plurality of tube top engaging components 28 extending axially with respect to the axis PA and disposed interiorly of the gripper drive member 17. Each tube top engaging component 28 has a frictional engagement member 27 mounted at one end thereof and facing outwardly with respect to the housing 15. Each tube top engaging component 28 is rotatably mounted by a conventional ball bearing assembly to a slotted component 25. The slotted component 25 includes an axially extending slot 33 for receiving therein a pin 34 extending radially with respect to the axis PA and fixedly connected to the gripper drive member 17. The slotted component 25 is fixedly mounted to a shifter rod 23 generally coaxially disposed on the axis PA. The tube top engaging components 28 are also movably supported by a movement control assembly 29 on the gripper drive member 17.

The shifter rod 23 extends axially beyond the neck of the gripper drive member 17 which is engaged by the driven arm 14 and the outwardly axially extending portion of the shifter rod 23 includes a switch element 24 which can be, for example, a conventional proximity switch. The shifter rod 23 is axially movable relative to the housing 15 and the extent of the axial movement of the shifter rod 23 is controlled by the travel of the axial slot 33 relative to the pin 34. Accordingly, the tube top engaging components 28, the slotted component 25, and the shifter rod 23 are axially movable as a single unit relative to the gripper drive member 17 and the housing 15. A spring 26, mounted between a radially projecting portion of the shifter rod 23 and the housing 15, biases the shifter rod 23 to project axially outwardly in the direction of the top open end of the housing 15.

The tube engaging member additionally includes a generally annular tube insertion component 30 having an outer diameter compatibly configured with the generally annular inner circumference defined by the tube top engaging components 28. The tube insertion component 30 is disposed interiorly of the tube top engaging components 28 and is axially movable relative thereto. A plurality of springs 31 movably interconnects the tube insertion component 30 and the tube top engaging components 28.

Figure 6:
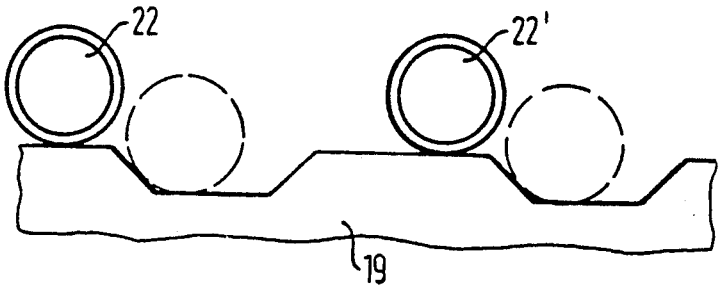
FIG. 6 is a schematic representation of a portion of the pivot movement converting means of the individual tube gripping apparatus shown in FIGS. 2 and 4.

Each tube gripping apparatus additionally includes a pivot movement converting means comprising a pair of rollers 22, 22' rotatably mounted by a pair of pins 35, 35', respectively, to the gripper drive member 17, and a cam means mounted to the tube engaging member and including a cam surface, as best seen in FIG. 6, formed on the top of the ring 19 for cam following movement with the rollers 22, 22'. The cam surface has an axially varying contour with respect to the axis PA.

Figure 7:
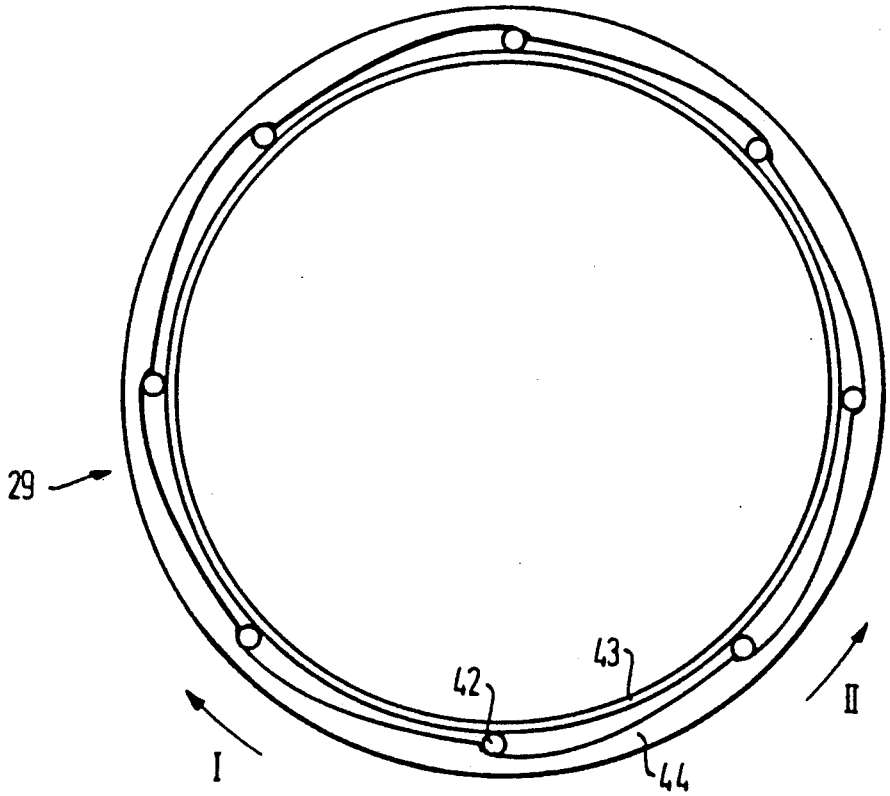
FIG. 7 is a plan sectional view of the tube gripping apparatus shown in FIGS. 2 and 4, taken along lines VII—VII of FIG. 4.

The movement control assembly 29 includes, as best seen in FIG. 7, a cam ring 44 formed on the interior of the gripper drive member 17, a plurality of circumferentially spaced rollers 42 rotatably mounted on the tube top engaging components 28. The cam ring 44 of the movement control means 29 permits the gripper drive member 17 to pivot independently of the tube top engaging components 28 in one rotational direction with respect to the axis PA (the one rotational direction being designated I in FIG. 7). When the gripper drive member 17 is pivoted in the opposite direction (designated as the direction II in FIG. 7), the cam ring 44 engages the roller 42 to effect synchronous pivoting of the tube top engaging components 28 and the gripper drive member 17.

Figure 3:
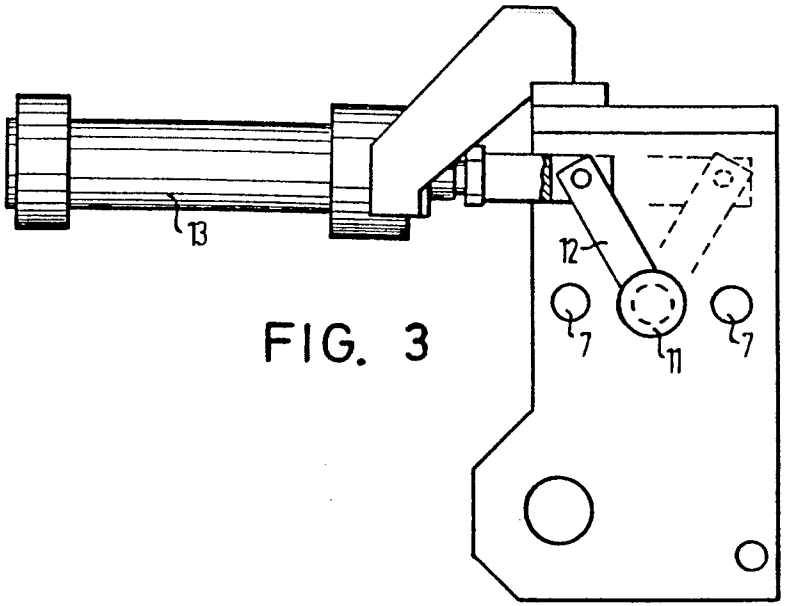
FIG. 3 is a front elevational view of the gripper assembly shown in FIG. 2, taken along lines III—III thereof.
Figure 4:
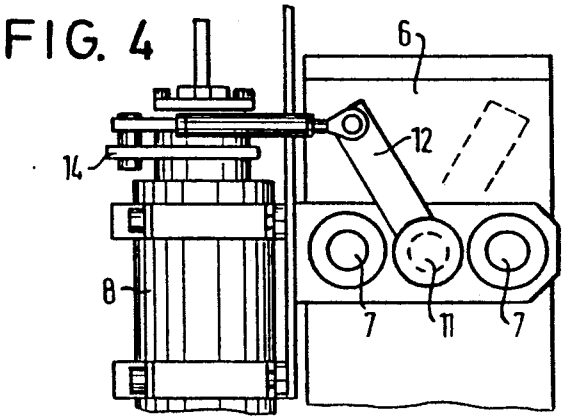
FIG. 4 is a front elevational view of the gripper assembly shown in FIG. 2, taken along lines IV—IV thereof.

Before describing the operation of each tube gripping apparatus 8 for individually gripping a tube, reference is made to FIGS. 1–4 to further describe the gripper assembly 9. Each carriage 10, which slidably mounts a respective one of the tube gripping apparatus 8 to the slide bar member 7, includes a central throughbore in which a common drive shaft 11 is rotatably received. The common drive shaft 11 extends parallel to, and is spaced between, the slide bar members 7 and is rotatably mounted to the frame 6. As best seen in Figures 2 and 3, a connecting arm 12 is fixedly connected at one end to the common drive shaft 11 and is movably connected to the free end of the piston of the pneumatic cylinder and piston assembly 13. Accordingly, the common drive shaft 11 is selectively pivotable about its axis in response to extension and retraction of the piston of the pneumatic cylinder and piston assembly 13. The connecting arm 12 and the common drive shaft 11 are movable between the solid line position and the broken line position shown in FIG. 3 through selective extension and retraction of the piston.

As best seen in FIG. 2, the driven arm 14 of each tube gripping apparatus 8 is interconnected by a link arm 36 to a connecting arm 12 which is fixedly mounted to the common drive shaft 11. Each link arm 36 is movably connected to the free end of the respective connecting arm 12 and to the free end of the respective driven arm 14. Accordingly, pivoting movement of the common drive shaft 11 about its axis effects corresponding pivoting movement of each respective driven arm 14 about the respective axis PA of each tube gripping apparatus 8.

The operation of the gripper assembly 9 and the tube gripping apparatus 8 is as follows. The gripper assembly 9 is positioned through appropriate pivoting about the shafts 3 and sliding movement of the frame 6 along the cylindrical shafts 5 to a position for grasping full bobbins on a bobbin bank of a textile fly frame. The tube gripping apparatus 8 are appropriately spaced from one another by the tube gripping apparatus spacing means, which is not described in further detail herein, to position each tube gripping apparatus 8 in alignment with a respective full bobbin for gripping engagement of the tube thereof.

Prior to engaging the tubes, the tube gripping apparatus 8 are disposed in their tube release disposition shown in FIG. 5. Specifically, the pneumatic cylinder and piston assembly 13 is operated to appropriately pivot the common drive shaft 11 to effect rotation of the driven arms 14 of the tube gripping apparatus 8 in the same selected clockwise or counterclockwise direction of rotation relative to the respective axis PA of the tube gripping apparatus. As seen in FIG. 6, the rotational direction of the driven arms 14 is selected to effect axial movement of the tube engaging member relative to the housing 15 in a direction toward the bottom open end of the housing 15. As seen in FIG. 6, the pivoting of the gripper drive member 17, which is driven by the respective driven arm 14, is converted by the pivot movement converting means to axial movement of the tube engaging member relative to the housing 15. Specifically, the rollers 22 move angularly with respect to the axis PA and the cam surface formed on the top of the ring 19 is axially biased by the springs 20 to continuously remain in engagement with the rollers 22, 22' during angular movement of the rollers. Accordingly, the gripper portions 18, which are commonly connected to the ring 19, move axially outwardly with respect to the housing 15 as the rollers 22, 22' move into angular alignment with certain angular portions of the cam surface formed on the ring 19 as schematically shown in FIG. 6. When the rollers 22, 22' are in the solid line position shown in FIG. 6 with respect to the ring 19, the gripping portions 18 are displaced axially outwardly with respect to the housing 15. The extent of the pivoting of each gripper drive member 17 corresponds to the pivoting of the common drive shaft 11 by the pneumatic cylinder and piston assembly 13. Accordingly, to position each tube gripping apparatus 8 in its tube release disposition as shown in FIG. 5, each gripper drive element 17 is pivoted through a predetermined angular displacement to effect axial outward movement of the gripper portions 18 of the tube gripping apparatus 8. In correspondence with the axial outward movement of the gripping portions 18, the shifter rod 23 is shifted axially to displace the tube top engaging components 28 and the tube insertion component 30 axially outwardly with respect to the housing 15.

With each tube gripping apparatus 8 in its tube release disposition as shown in FIG. 5, the gripper assembly 9 is lowered by conventional means along the cylindrical shafts 5 and the gripping portions 18 of each tube gripping apparatus 8 receive the top portion of the aligned tube therein. Simultaneously with the receipt of the top portion of the tube interiorly of the gripping portions 18, the friction members 27 of the tube top engaging components 28 engage the top rim of the tube, thereby preventing further axial movement of the tube top engaging components 28 during continued axial movement of the gripping portions 18 downwardly over the engaged tube. The tube insertion component 30 of each tube gripping apparatus 8 is inserted during this downward movement into the interior of the tube until engagement with the top of the spindle on which the tube is supported prevents further downward movement of the tube insertion component 30. Accordingly, when the gripper assembly 9 has completed its downward movement to effect receipt of the top portion of the tubes by the tube gripping apparatus 8, the gripping portions 18 of each tube gripping apparatus 8 are disposed circumferentially around the top portion of the tube, the friction members 27 of the tube top engaging components 28 are in engagement with the top of the tube and the tube insertion component 30 is disposed interiorly of the tube.

To effect compressive gripping of the tubes by the gripping portions 18 of the tube gripping apparatus 8, the pneumatic cylinder and piston assembly 13 is controlled to oppositely pivot the common drive shaft 11 by a predetermined extent. The predetermined pivoting of the common drive shaft 11 is transmitted via the connecting arms 12 and the link arms 36 to the driven arms 14 to rotate the respective gripper drive member 17. Specifically, as seen in FIG. 6, the rotation of the gripper drive element 17 effects angular movement of the rollers 22, 22' to their broken line position and the springs 20 bias the cam surface formed on the top of the ring 19 to remain in continuous engagement with the rollers 22, 22', thereby effecting inward axial movement of the gripping portions 18 with respect to the housing 17 in correspondence with the cam following engagement of the cam surface on the ring 19 and the rollers 22, 22'.

As the gripping portions 18 move axially inwardly with respect to the housing 15, the tapered surfaces on the bottom open end of the housing 15 cooperates with the tapered outer surfaces 32 of the gripping portions 18 to effect radial inward movement of the gripping portions 18 with respect to the axis PA, thereby effecting compressive gripping of the engaged tube between the opposing gripping portions 18. This tube gripping disposition of the tube gripping apparatus 8 is illustrated in FIG. 8. The total angular movement of the gripper drive member 17 during this tube gripping operation is approximately 60°. However, the angular displacement of the rollers 22, 22' need only be generally less than 10° to effect axial inward movement of the gripping portions 18 sufficient to grip the engaged tube. The balance of the pivoting movement of the gripper drive member 17 is transmitted by the movement control component 29 to the tube top engaging components 28 for a purpose described in more detail below.

The tube top engaging components 28 and the tube insertion component 30 move axially inwardly in correspondence with the axial inward movement of the gripping portions 18 through appropriate axial shifting of the shifter rod 23. Specifically, the shifter rod 23 is moved axially outwardly with respect to the housing 15 to the extent of travel of the pin 34 in the axial slot 33 of the slotted component 25.

With the tubes thus compressively gripped by the gripping portions 18 of the tube gripping apparatus 8, the gripper assembly 9 is moved along the cylindrical shafts 5 to effect removal of the gripped tubes from their respective spindles on the bobbin bank. During this removal of the tubes from their respective spindles, the tube insertion components 30, which have heretofore rested on top of the spindles, are moved axially outwardly with respect to the housing 15 under the action of the springs 31 interiorly of the engaged tubes. The tube insertion component 30 thereby acts to stabilize the engaged tube during its gripping by the gripping portions 18. Likewise, the tube top engaging components 28, whose friction members 27 are maintained in engagement with the top of the engaged tube, acts to stabilize the tube during its gripping by the gripping portions 18.

Once the engaged tubes are removed from their respective spindles on the bobbin bank, the gripper assembly 9 is manipulated in conventional manner to position the engaged tubes for insertion onto the pegs 41 of the peg support means 40. This manipulation of the gripper assembly 9 includes pivoting of the gripper assembly about the shafts 3 and adjustment of the lateral spacing of the tube gripping apparatus 8 from each other to align the engaged tubes with the pegs 41 of the peg support means 40. Following these adjustments, the gripper assembly 9 is vertically lowered along the cylindrical shafts 5 to effect insertion of the bottom of the engaged tubes onto the pegs 41 while the tubes continue to be engaged by the tube gripping apparatus 8.

Once the engaged tubes have been securely seated on the pegs 41 of the peg support means 40, the pneumatic cylinder and piston assembly 13 is controlled to pivot the common drive shaft 11 through a predetermined extent to effect a predetermined pivoting of the gripper drive member 17 of each tube apparatus 8. The controlled pivoting of the gripper drive member 17 is transmitted via the rollers 22, 22' and the cam surface on the ring 19 of the pivot movement converting means of each tube gripping apparatus 8 into axial movement of the gripping portions 18 outwardly of the housing 15. Specifically, the rollers 22, 22' are angularly displaced relative to the axis PA from the broken line position to the solid line position shown in FIG. 6, thereby pushing the ring 19 in the axial direction toward the tube and, correspondingly, causing extension of the gripping portions 18 outwardly of the housing 15. As the gripping portions 18 travel outwardly beyond the bottom open end of the housing 15, the gripping portions 18 move radially outwardly and thereby release the engaged tube from gripping engagement. Once the tube has been released by the gripping portions 18, the gripper assembly 9 is raised along the cylindrical shafts 5 to clear the tube gripping apparatus 8 from the tubes, which are now seated on the pegs 41 of the peg support means 40. The gripper assembly 9 is then available for another tube transfer operation.

Typically, once the gripper assembly 9 has completed a transfer of full bobbins from a bobbin bank of a textile fly frame to the peg support means 40, the gripper assembly 9 is then operated to transfer empty tubes which are supported on another plurality of the pegs 41 on the peg support means 40 to the nowempty spindles on the bobbin bank. The tube engagement and movement operation by the gripper assembly 9 and its tube gripping apparatus 8 is executed in essentially the same fashion as the transfer of the full bobbins by the gripper assembly with the additional operational step that the empty tubes are securely seated on the spindles of the bobbin bank by the tube gripping apparatus in a temporary locking manner by a predetermined pivoting of the tube top engaging components 28. Specifically, the tubes typically used in a textile fly frame operation are provided with specially configured recesses formed in the bottom end portions thereof. The spindles of the bobbin bank are provided with recess engaging members compatibly configured with the tube recesses for engaging the recesses to effect temporary firm securement of the empty tubes on spindles. Typically, the empty tubes are pivoted about their axis by a predetermined extent to effect locking interengagement between their tube recesses and the recess engaging members of the spindles.

Each tube gripping apparatus 8 effects interengagement of the tube recess of its respective gripped tube and the recess engaging member of the spindle on the bobbin bank in the following manner. As discussed previously, the rollers 22, 22' of the pivot movement converting means of each tube gripping apparatus 8 need only be moved through a relatively small angular extent of approximately 10° to effect the necessary axial displacement of the gripping portions 18 between their tube gripping dispositions and their tube release dispositions. However, the gripper drive members 17 are typically pivoted through an extent of greater than 10° (i.e., normally, an extent in the range of 60°) through the operation of the pneumatic cylinder and piston assembly 13, the common drive shaft 11 and the interconnected assembly of the connecting arm 12, the link arm 36 and the driven arm 14. This surplus pivoting of the gripper drive member 17 acts to pivot the engaged tube through a predetermined extent to effect interengagement of the tube's recess and the recess engaging member of the respective spindle onto which the tube is being inserted. Specifically, the pivoting of the gripper drive member 17 is transmitted via the movement control means 29 to the tube top engaging components 28 due to the entrained movement of the rollers 42 on the tube top engaging components 28 by the cam ring 44 of the movement control means 29.

As seen in FIG. 7, as the gripper drive member 17 is pivoted in the direction II, the cam ring 44 entrains the rollers 42 to effect pivoting of the tube top engaging components 28 in correspondence with the pivoting of the gripper drive member 17. The friction members 27 at the base of the tube top engaging components 28 frictionally engage the top rim or surface of the engaged tube to entrain the tube for pivoting movement in correspondence with the pivoting of the tube top engaging component 28. As the entrained tube pivots, its recess is moved into interengagement with the recess engaging members of the spindle of the bobbin bank to effect firm, temporary securement of the tube to the spindle.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for selectively gripping a tube of the type onto which yarn is built by a textile machine to form a yarn package, comprising:

a housing;

a tube engaging member movably supported on said housing for relative axial movement with respect to said housing along a pivot axis, said tube engaging member including a pair of gripping portions, at least one of said gripping portions being selectively movable radially inwardly with respect to said pivot axis to effect compressive gripping of a tube disposed between said gripping portions by said gripping portions;

a gripping portion drive member movably supported on said housing for pivotal movement about said pivot axis;

means for pivoting said gripping portion drive member about said pivot axis;

means for moving said at least one gripping portion radially inwardly in response to relative axial movement of said tube engaging member with respect to said housing;

pivot movement converting means for axially moving said tube engaging member with respect to said housing in response to pivoting of said gripping portion drive member about said pivot axis, whereby said at least one gripping portion moves radially inwardly to effect compressive gripping of a tube by said gripping portions; and said pivot movement converting means including a pair of rollers, said rollers being mounted on a selected one of said gripping portion drive member and said tube engaging member, cam means mounted to the other of said gripping portion drive member and said tube engaging member, said cam means including a cam surface having an axially varying contour with respect to said pivot axis and means for continuously biasing said rollers into engagement with said cam surface whereby said tube engaging member moves axially relative to said housing as said rollers move along said cam surface in cam following fashion during pivoting of said gripping portion drive member.

2. The apparatus according to claim 1 and characterized further in that said tube engaging member includes an annular tube top engaging component, said tube top engaging component being disposed between said gripper portions, and means for movably supporting said tube top engaging component on said gripping portion member for selected relative pivoting movement between said tube top engaging component and said gripping portion drive member, said tube top engaging component frictionally engaging the top of a tube which is compressively engaged by said gripping portions.

3. The apparatus according to claim 2 and characterized further in that said means for movably supporting said tube top engaging component on said housing includes a shifter rod movably supported on said housing and connected to said tube top engaging component by a ball bearing assembly, said ball bearing assembly permitting pivoting movement of said tube top engaging component relative to said shifter rod and a portion of said shifter rod extending axially beyond said housing, and control means having a proximity switch for responding to the axial position of said shifter rod, the proximity switch being mounted to the portion of said shifter rod extending axially beyond said housing and the control means being operable to evaluate the movement of the proximity switch into an axially shifted position as an indication that said shifter rod has axially moved in correspondence with the frictional engagement of the top of a tube by said tube top engaging component.

4. The apparatus according to claim 3 and characterized further in that said tube engaging member includes a tube insertion component disposed in said tube top engaging component, said tube insertion component being compatibly configured with the inner diameter of a tube to be gripped for insertion in the tube to stabilize the tube during gripping by said gripper portions, said tube insertion component being movably connected to said shifter rod for axial shifting of said tube insertion component by said shifter rod to selectively insert and retract said tube insertion component into and from a tube to be gripped.

5. The apparatus according to claim 3 and characterized further in that said gripping portion drive member includes a radially extending pin and said shifter rod includes an axially extending slot for receiving said gripping portion drive member pin therein, said slot permitting axial movement of said shifter rod and said tube top engaging component relative to said gripping portion drive member and said shifter rod slot and said gripping portion drive member pin cooperating together to stabilize said shifter rod ball bearing assembly with respect to said gripping portion drive member during relative pivotal movement between said tube top engaging component and said gripping portion drive member.

6. The apparatus according to claim 1 and characterized further in that said rollers are disposed generally diametrically opposite to one another relative to said pivot axis.

7. An assembly for groupwise exchange of full bobbins and tubes between the bobbin bank of a textile fly frame and a creel, comprising:

a support frame;

a plurality of tube gripping apparatus mounted on said support frame for selectively gripping a tube of the type onto which yarn is built to form a yarn package, each tube gripping apparatus including a housing, a tube engaging member movably supported on said housing for relative axial movement with respect to said housing along a pivot axis, said tube engaging member including a pair of gripping portions, at least one of said gripping portions being selectively movable radially inwardly with respect to said pivot axis to effect compressive gripping of a tube disposed between said gripping portions by said gripping portions, a gripping portion drive member movably supported on said housing for pivotal movement about a pivot axis, means for pivoting said gripping portion drive member about said pivot axis, means for moving said at least one gripping portion radially inwardly in response to relative axial movement of said tube engaging member with respect to said housing, and pivot movement converting means for axially moving said tube engaging member with respect to said housing in response to pivoting of said gripping portion drive member about said pivot axis, whereby said at least one gripping portion moves radially inwardly to effect compressive gripping of a tube by said gripping portions;

said pivot movement converting means including a pair of rollers, said rollers being mounted on a selected one of said gripping portion drive member and said tube engaging member, cam means mounted to the other of said gripping portion drive member and said tube engaging member, said cam means including a cam surface having an axially varying contour with respect to said pivot axis and means for continuously biasing said rollers into engagement with said cam surface whereby said tube engaging member moves axially relative to said housing as said rollers move along said cam surface in cam following fashion during pivoting of said gripping portion drive member; and;

means for commonly driving said gripping portion drive members.

8. The assembly according to claim 7 and characterized further in that said commonly driving means includes a common drive shaft extending transversely with respect to said pivot axes and rotatably supported on said support frame, means for rotating said common drive shaft about its axis, and a plurality of linkage means individually interconnecting said common drive shaft and said gripping portion drive members for driving movement of said gripping portion drive members in response to rotation of said common drive shaft.

9. The assembly according to claim 7 and characterized further in that each said linkage means includes a driven arm connected to a respective one of said gripping portion drive members and extending radially therefrom, a drive arm connected to said shaft and extending radially therefrom and a linking arm interconnecting said driven arm and said drive arm.

* * * * *